United States Patent [19]

Wolniak et al.

[11] Patent Number: 4,633,689

[45] Date of Patent: Jan. 6, 1987

[54] ANTI-STATIC SWITCH LOCK WITH MOMENTARY POSITION

[75] Inventors: Stanley C. Wolniak, Vernon Hills; Timothy P. Laabs, Maywood; Richard H. Schulz, Jr., Elk Grove Village, all of Ill.

[73] Assignee: The Eastern Company, Naugatuck, Conn.

[21] Appl. No.: 646,790

[22] Filed: Sep. 4, 1984

[51] Int. Cl.[4] ..... H01H 27/06; E05B 17/04

[52] U.S. Cl. ..... 70/379 R; 70/372; 70/DIG. 36; 70/DIG. 62; 200/43.08; 200/61.66

[58] Field of Search ..... 70/379 A, 379 R, 380, 70/252, 372, 374, DIG. 36, DIG. 62; 403/229; 200/61.64, 61.66, 61.76, 43.01, 43.02, 43.08, 43.11

[56] References Cited

U.S. PATENT DOCUMENTS

| | | | |
|---|---|---|---|
| 1,714,426 | 5/1929 | Kuepfer | 70/DIG. 36 X |
| 3,270,151 | 8/1966 | Godette | 70/372 X |
| 3,595,039 | 7/1971 | Juy | 70/252 |
| 3,914,967 | 10/1975 | Arman | 70/252 |
| 4,227,056 | 10/1980 | Johnston et al. | 200/43.11 |
| 4,309,882 | 1/1982 | Maiocco | 70/252 X |
| 4,427,852 | 1/1984 | Wolniak et al. . | |

*Primary Examiner*—Robert L. Wolfe
*Assistant Examiner*—Russell W. Illich
*Attorney, Agent, or Firm*—Wood, Dalton, Phillips, Mason & Rowe

[57] ABSTRACT

An actuating structure is provided for a switch lock having a barrel with a plug which is key actuated for rotation therein. An actuator interconnects the rotatable plug with a rotatable shaft of the switch and cooperates with a rotatable stop plate connected to a return spring. Specifically, an actuator lug and a stop plate surface which engage upon rotation of the plug in one direction to turn the switch momentarily from the first position to a second position against the action of the spring. The actuator also rotates in the opposite direction independently of the stop plate to turn the switch from the first to a third position.

12 Claims, 8 Drawing Figures

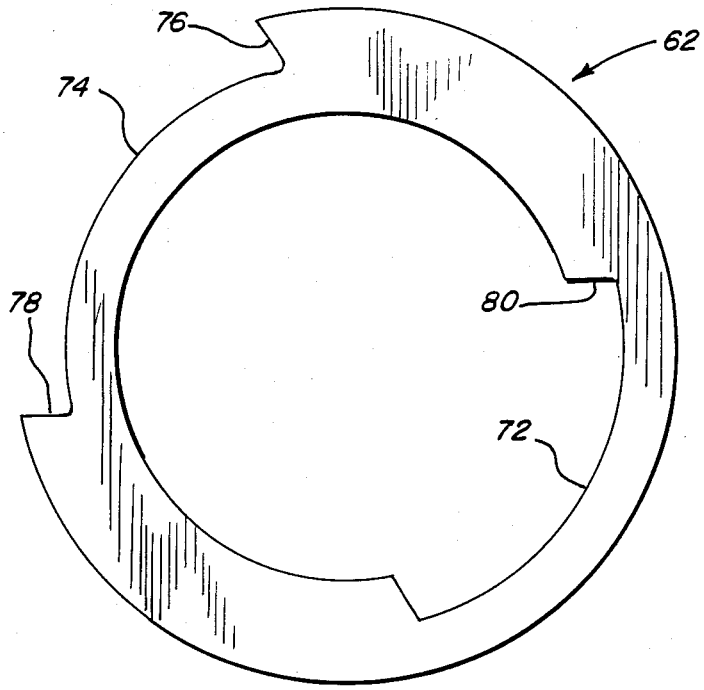
FIG. 6
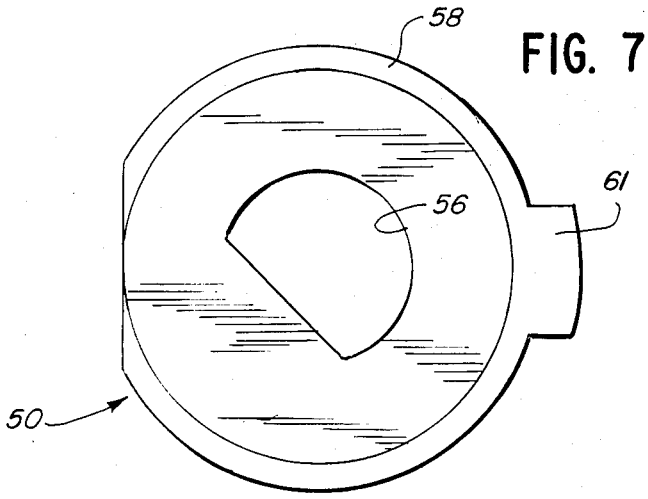
FIG. 7
FIG. 8
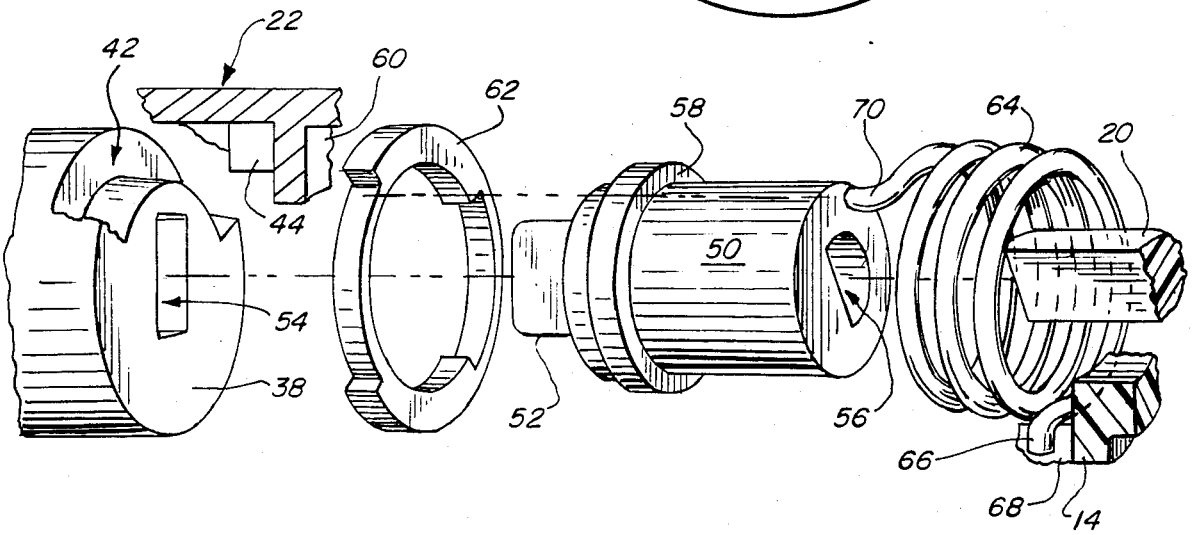

ANTI-STATIC SWITCH LOCK WITH MOMENTARY POSITION

BACKGROUND OF THE INVENTION

1. Field of the Invention

This invention relates to key operated switches and more particularly to anti-static switch locks having three positions, one of which is momentary.

2. Description of the Prior Art

Anti-static switch locks occurring in the prior art are exemplified by U.S. Pat. No. 4,427,852 issued to Wolniak et al on Jan. 24, 1984. Locks of this type have a barrel which houses a rotatable, key operated plug. The plug is suitably secured to a rotor to rotate therewith, the rotor being disposed to connect the various terminals of a terminal assembly upon rotation of the plug. A spring is provided to bias the lock toward one of its two positions.

In certain instances however (e.g. automobile ignitions), it is desirable to have a key operated switch with three positions where one position is "momentary" (i.e. the switch lock is biased away from the momentary position so that it will stay in the position only so long as the key operator holds the key).

SUMMARY OF THE INVENTION

In one aspect of the present invention, an actuating structure is provided for a switch lock having a barrel with a plug which is key actuated for rotation therein. A coupling interconnects the rotatable plug with a rotatable shaft of the switch and cooperates with a rotatable stop plate connected to a return spring. Specifically, the coupling and stop plate have surfaces which engage upon rotation of the plug in one direction to turn the switch momentarily from the first position to a second position against the action of the spring. The coupling also rotates in the opposite direction independently of the stop plate to turn the switch from the first to a third position.

It is the object of the present invention to provide a simple, inexpensive, and effective switch lock which has three positions, one of which is momentary.

BRIEF DESCRIPTION OF THE DRAWINGS.

FIG. 6 is a plan view of the stop plate;

FIG. 7 is an end view of the actuator; and

FIG. 8 is an exploded partial view of the switch lock.

DESCRIPTION OF THE PREFERRED EMBODIMENT

Figure 1:
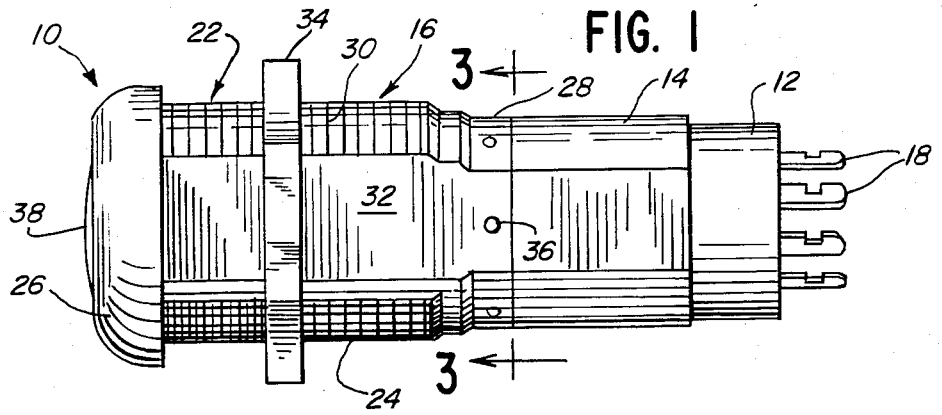
FIG. 1 is a side view of the assembled switch lock.

FIG. 1 illustrates the assembled anti-static switch lock 10 of the present invention. Externally, this lock is substantially similar to known switch locks such as shown in, for example, U.S. Pat. No. 4,427,852. Specifically, the switch lock 10 includes a terminal assembly 12 mounted to a hub 14, the hub 14 in turn being secured to a key lock assembly 16.

The terminal assembly 12 does not form a part of the invention as described herein, and therefore only those parts and functions necessary for an understanding of the present invention will be set forth. The terminal assembly (which is electrically insulated from the remainder of the switch lock 10) mounts a plurality of terminals 18 and houses a rotor (not shown). By turning an insulated, semi-circular shaft 20 (see FIG. 8) connected to the rotor, desired electrical connections between the terminals 18 may be effected. The terminals 18 are connected to the electrical circuit for which the protection offered by the switch lock 10 is required.

It should be noted that various terminal assemblies 12 can be substituted for the four-terminal assembly shown in the drawings depending upon the switching requirements between the terminals. Therefore, whenever the terminal assembly 12 is referred to, it is to be understood that the description is not to be limited to only the four-terminal assembly 12 illustrated.

To rotate the shaft 20 of the terminal assembly 12, the key lock assembly 16 is used. The key lock assembly 16 includes a barrel 22 consisting of a body 24 having an escutcheon 26 at one end and a barrel end 28 at the other end. The body 24 is cylindrical, having outer threads 30 interrupted by opposing flats 32 which, in cooperation with a nut 34, serve to mount the switch lock 10 to a panel board.

The hub 14 is suitably secured to the barrel end 28, as by the indentations or stakes 36 shown.

A rotatable lock plug 38 is received in the body 24 and has suitable tumblers and tumbler stops therein (not shown) so that the plug 38 may be turned within the barrel 22 only when a proper key 40 (see FIG. 2) is inserted therein. Such barrel and key plug assemblies are well known in the art and are illustrated in, for example, the above-mentioned U.S. Pat. No. 4,427,852, the disclosure of which is hereby incorporated by reference.

FIG. 8 illustrates the interior components of the switch lock 10 in an exploded view. In particular, the lock plug 38 received in the barrel 22 is located to the left in FIG. 8. The lock plug 38 includes a slot 42 which will engage a stop 44 on the barrel 22 to limit its rotation therein.

A coupling or actuator 50 has a tongue 52 on one end received within a matching opening 54 in the lock plug 38 so that the actuator 50 rotates with the lock plug 38. The actuator 50 also has a semi-circular opening 56 in its opposite end within which is received the terminal assembly shaft 20 so that the rotor (not shown) is also casued to rotate with the actuator 50 and lock plug 38.

A flange 58 around the actuator 50 rides on a flange 60 about the interior of the barrel 22. An actuator lug 61 (see FIG. 7) is included on the actuator flange 58.

A stop plate 62 is located around the actuator flange 58 and also rides on the barrel flange 60 so as to be axially aligned with the actuator flange 58. An inwardly projecting barrel lug 63 (see FIGS. 3–5) is also provided which is spaced from the flange 60 and axially aligned with the stop plate 62.

A coil spring 64 is located over the actuator 50 and has one end 66 biased against a lug 68 in the hub 14 and has its other end 70 biased against the stop plate 62.

The stop plate 62 is more fully shown in FIG. 6 and is essentially in the shape of a ring with two slots, one 72 on its inner side and one 74 on its outer side. A first surface 76 against which one end 70 of the coil spring 64 abuts is defined in the outer slot 74. This surface 76 is at an angle from the radial direction so as to help ensure that the spring end 70 stays within the slot 74. A second surface 78 is defined in the opposite end of the outer slot 74 and still another surface 80 is defined at one end of the inner slot 72. These surfaces 76-80 function to provide for the momentary and maintaining switch positions of the switch lock 10 as will be apparent from the description hereafter of the operation of the switch lock 10.

Operation of the switch lock 10 can be seen in FIGS. 2-5. The switch lock 10 is illustrated in a first position in FIG. 2. By turning the key 40 clockwise, the switch may be turned to a second position which is "momentary". This position is referred to as "momentary" because, when the key 40 is released, the switch lock 10 is automatically returned to the first position. By turning the key 40 counterclockwise from the first position the switch is turned to a third position which is "maintaining" in that it will stay in that position if the key 40 is released. The tumbler splines (not shown) are such that the key 40 may be removed from the lock plug 38 when the switch lock 10 is in one of the maintaining positions (i.e. the first or third positions) so that the key operator can lock the switch lock 10 in whichever of those positions is desired.

Figure 2:
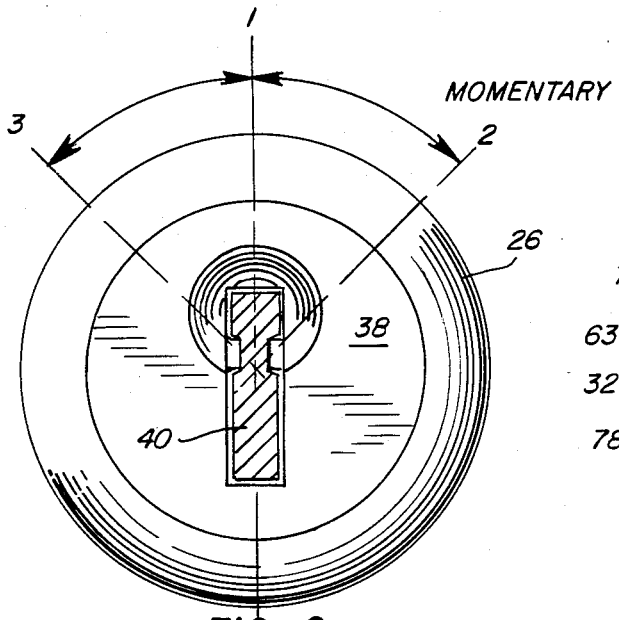
FIG. 2 is an end view of the switch lock.
Figure 3:
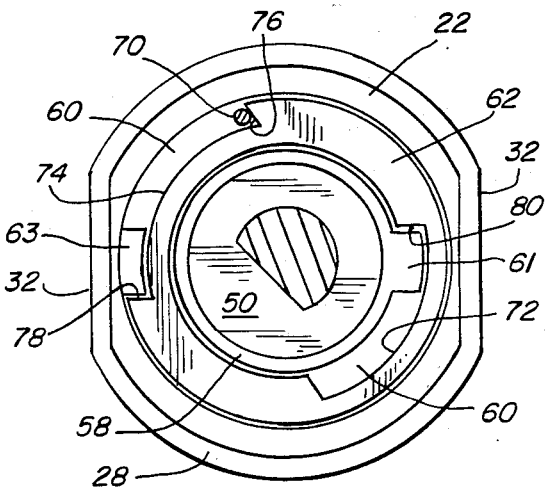
FIG. 3 is a view taken along line 3—3 of FIG. 1.
Figure 4:
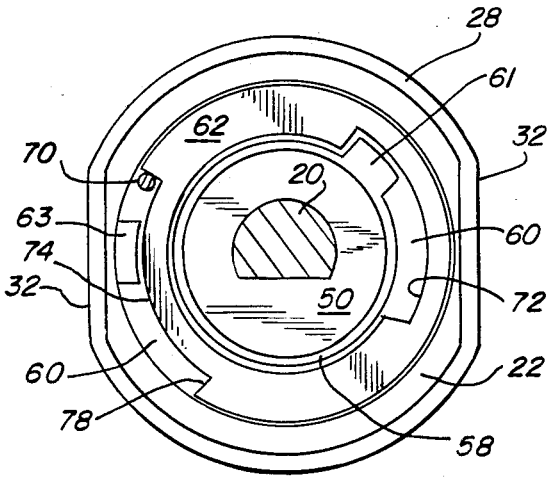
FIG. 4. is a view similar to FIG. 3 showing the switch lock in the momentary position.
Figure 5:
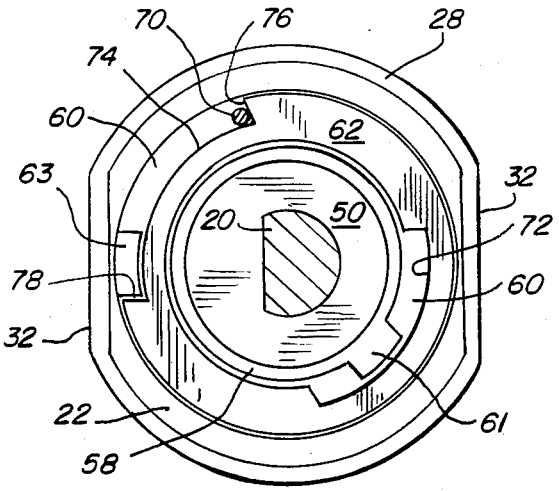
FIG. 5 is a view similar to FIG. 3 showing the switch lock in the maintaining position.

The individual components providing the abovedescribed operation are illustrated in the various positions in FIGS. 3-5. It should be kept in mind that each of these figures view the components from the opposite direction of that of FIG. 2, so that clockwise motion in FIG. 2 is counterclockwise in FIGS. 3-5 and vice versa. Therefore, the references hereafter to "clockwise" and "counterclockwise" should be understood as being from the perspective of FIGS. 3-5 (and will be opposite the description of the corresponding motion from the perspective of FIG. 2).

It should also be recalled that the key plug 38, actuator 50 and rotor are all interconnected for rotation together, and references hereafter to rotation of the actuator 50 (which is the component seen in FIGS. 3-5) necessarily also means that the key plug 38 and rotor are rotated as well. Therefore, the reader should not be misled by references to the operator "turning the actuator"; the operator actually turns the key plug 38 with the key 40 and the actuator 50 is turned with it. Further, the reader should keep in mind that while reference will be to rotation of the actuator 50, the significance of this is that the rotor is turned to change the particular connection of the terminals 18.

The switch lock 10 is shown in the first position in FIG. 3. The stop plate 62 is biased in a clockwise direction by the spring 64 (only one end 70 of which can be seen) and thus is held in the position shown by the abutment of the barrel lug 63 with the seond end surface 78 of its outer slot 74. The actuator 50 is positioned so that its lug 61 is against the end surface 80 of the inner slot 72.

By turning the actuator 50 counterclockwise, the actuator lug 61 is caused to bear upon the inner slot end surface 80 and turn the stop plate 62 against the bias of the spring 64. This moves the switch lock 10 to the second (momentary) position shown in FIG. 4 (rotation in this direction is limited by the stop 44 within the plug slot 42). The bias of the spring 64 is such that when the key 40 is released, the stop plate 62 is rotated clockwise back to the original position (shown in FIG. 3) thereby causing the actuator 50 to also be returned to its original position due to the abutment of the actuator lug 61 with the inner slot end surface 80 of the stop plate 62.

The actuator 50 may freely be turned clockwise from the first position to the third (maintaining) position as shown in FIG. 5 (this rotation is also limited by the stop 44 within the plug slot 42). The actuator lug 61 is disengaged from the inner slot end surface 80 and moves freely in the stop plate inner slot 72 when the switch lock 10 is changed between these positions since the stop plate 62 is prevented by the barrel lug 63 from turning further clockwise with the bias of the spring 64. As a result, there is no bias back toward the first position and the switch lock 10 will stay in the third position if the operator releases the key 40.

Other aspects, objects and advantages of the invention can be obtained from a study of the drawings, the specification and the appended claims.

We claim:

1. In a key operated switch including a lock having a barrel and rotatable plug with key actuated tumblers and a switch having a rotatable shaft, an improved switch actuator comprising:
   - a coupling interconnecting the rotatable plug with the rotatable shaft;
   - a rotatable stop plate;
   - a stop plate return spring connected with the stop plate, said coupling and stop plate having surfaces which engage upon rotation of the plug in one direction to turn the switch momentarily from a first position to a second position against the action of said spring;
   - means for securing the stop plate against the action of the return spring in an orientation corresponding to the switch first position; and
   - means associated with the stop plate for allowing rotation of the coupling in the opposite direction independently of the stop plate to turn the switch from the first to a third position.

2. The improved actuator of claim 1, wherein the securing means comprises a second stop plate surface adapted to engage a barrel surface against the action of the spring in the first position of the switch.

3. The improved actuator of claim 2, wherein said coupling surface is defined by an outwardly projecting lug on said coupling.

4. The improved actuator of claim 3, wherein said barrel surface is defined by an inwardly projecting lug in said barrel.

5. The improved actuator of claim 3, wherein the allowing means comprises a slot in the stop plate extending in the opposite direction from the first stop plate surface.

6. In a switch lock having a barrel with a plug which is key actuated for rotation therein, and a switch connected to said plug for rotation therewith, said switch having a first position and being rotatable in one direction therefrom to a second position and rotatable in the opposite direction to a third position, an improved actuating structure comprising:
   - a rotatable stop plate having first and second slots therein;
   - a first lug within the barrel and engaging one end of the first slot in the first position;
   - a return spring biasing the one end of the stop plate first slot toward the first lug; and
   - a second lug fixed with respect to the switch and engaging one end of the second slot during rotation from the first position toward the second position against bias of the spring, whereby said second lug disengages from the second slot one end to allow free turning of the switch between the first and third positions.

7. The improved actuating structure of claim 6, further comprising an actuator interconnecting the plug and switch, said second lug projecting from said actuator in axial alignment with the stop plate.

8. The improved actuating structure of claim 6, wherein the barrel includes a spline which aligns with plug tumblers when the switch is in at least one of the first and third positions to allow the actuating key to be removed therefrom to lock the switch in said one position.

9. In a key operated switch including a lock having a barrel and rotatable lug whith key actuated tumblers and a switch secured for rotation with the plug, an improved switch actuator comprising:

a rotatable stop plate;

a stop plate return spring connected with the stop plate;

a stop plate surface adapted to engage a surface secured relative to the plug, said engagement occurring upon rotation of the plug in one direction to turn the switch momentarily from a first position to a second position against the action of said spring;

means for securing the stop plate against the action of the return spring in an orientation corresponding to the switch first position; and means associated with the stop plate for allowing rotation of the switch and plug in the opposite direction independently of the stop plate to turn the switch from the first to a third position.

10. The improved actuator of claim 9, wherein the securing means comprises a second stop plate surface adapted to engage a barrel surface against the action of the spring in the first position of the switch.

11. The improved actuator of claim 10, wherein said plug related surface is defined by an outwardly projecting lug.

12. The improved actuator of claim 11, wherein the allowing means comprises a slot in the stop plate extending in the opposite direction from the first stop plate surface.

* * * * *